US006244768B1

(12) United States Patent
Chang et al.

(10) Patent No.: US 6,244,768 B1
(45) Date of Patent: Jun. 12, 2001

(54) RESILIENT ELASTOMERIC LINE PRINTER PLATEN HAVING OUTER LAYER OF HARD MATERIAL

(75) Inventors: Y. Grant Chang, Irvine; Norman E. Farb, Villa Park, both of CA (US)

(73) Assignee: Printronix, Inc., Irvine, CA (US)

( * ) Notice: Subject to any disclaimer, the term of this patent is extended or adjusted under 35 U.S.C. 154(b) by 0 days.

(21) Appl. No.: 09/261,042

(22) Filed: Mar. 2, 1999

(51) Int. Cl.[7] ..... B41J 11/057

(52) U.S. Cl. ..... 400/662; 400/658; 400/661; 400/661.1

(58) Field of Search ..... 400/662, 661.1, 400/661, 659, 658, 656; 101/93.04; 492/28, 48, 49, 50, 53, 54, 56

(56) References Cited

U.S. PATENT DOCUMENTS 4,318,452 * 3/1982 Reitner ..... 400/661
4,780,729 * 10/1988 Murakami et al. ..... 400/662
4,790,674 * 12/1988 Kleist et al. ..... 101/93.04
4,881,838 * 11/1989 Lohrmann et al. ..... 400/662
5,492,769 * 2/1996 Pryor et al. ..... 428/552
5,816,724 * 10/1998 Hada et al. ..... 400/656
6,000,330 * 12/1999 Farb et al. ..... 101/93.04

* cited by examiner

*Primary Examiner*—John S. Hilten
*Assistant Examiner*—Leslie J. Grohusky
(74) *Attorney, Agent, or Firm*—George F. Bethel

(57) ABSTRACT

A line printer with a hammerbank having print hammers with printing tips and a ribbon supported for impact by the tips for printing on media and a metal platen for supporting the media. An elastomer on the metal platen supports the media and has a layer of material harder than the elastomer extending inwardly from its surface which receives the impacts of the hammer tips. The harder material can be particles extending inwardly randomly from the surface of the elastomer of a ceramic having a sphericity exceeding 0.50 up to 35 percent of the thickness of the elastomer, and in the range of 20 microns to 400 microns in size.

28 Claims, 5 Drawing Sheets

FIG. 3
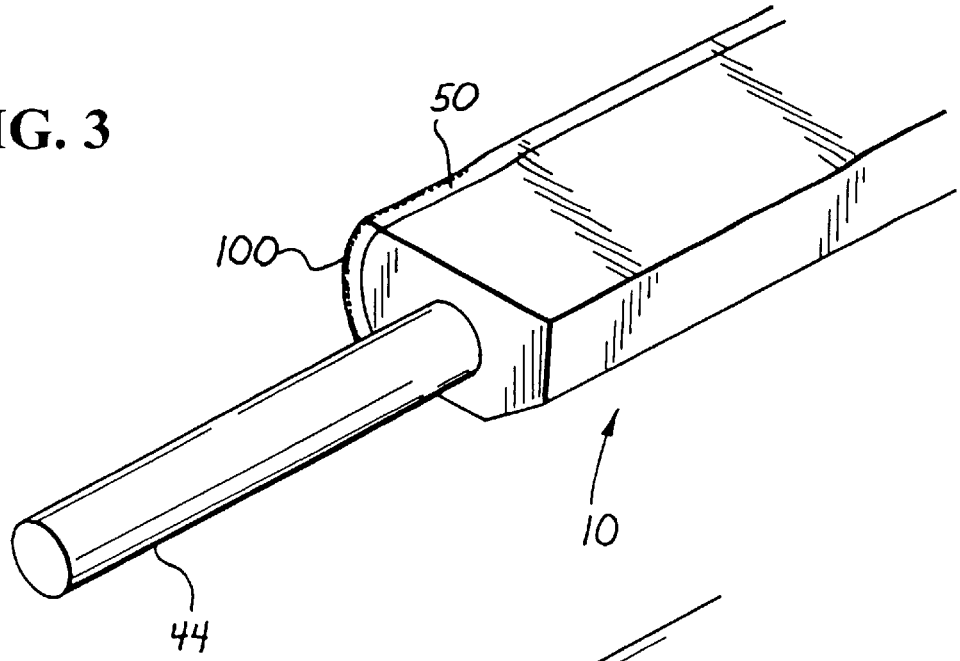
FIG. 4
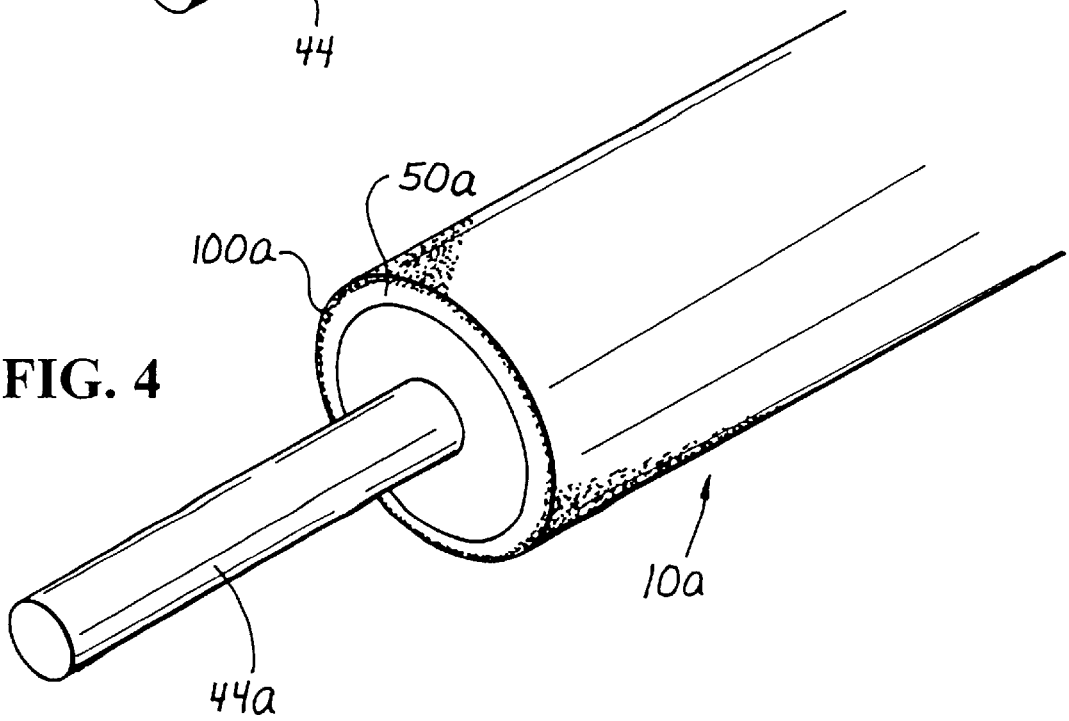
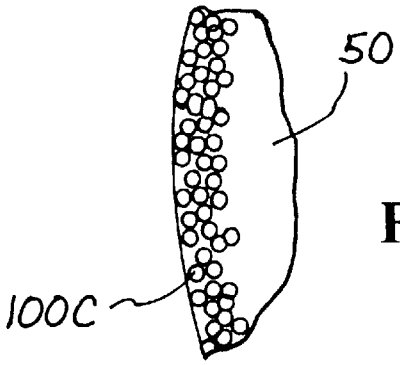
FIG. 6C

RESILIENT ELASTOMERIC LINE PRINTER PLATEN HAVING OUTER LAYER OF HARD MATERIAL

BACKGROUND OF THE INVENTION

1. Field of the Invention

The field of this invention is within the printing art, specifically impact printing. More specifically, it is within the field of printing that relies upon hammers that are released from a hammerbank such as in a line printer. These hammers impact a ribbon against media that is to be printed upon that is in turn supported for impact against a platen. More particularly, it relates to the platen which is impacted by the hammers of the printer.

2. Description of the Prior Art

Prior art impact printers such as line matrix printers often employ a hard non-resilient non-elastic platen. This platen is impacted by hammers that are fired from a hammerbank having tips. The tips specifically impact a ribbon and paper or other media between the tips and the platen.

On the other hand some platens are made of an elastomeric material.

The foregoing hard platens create very high impact forces to the hammerspring that is released and fired against the platen and the intervening ribbon. Due to the high stiffness or modulus of the hammersprings, a very high impact force is encountered by the platen and ribbon.

Ribbons tend to deteriorate rapidly due to the fact that the tips of the hammers forming the dot matrix patterns apply great loads on the ribbon as they impact against the ribbon, paper or media, and platen against which they are supported. This ribbon deterioration can sometimes take place substantially before the normal ink life of a ribbon.

The deterioration factor is caused by these high impact forces continually and permanently flattening the threads of the ribbon. Eventually, these threads break and cause ribbon wear and in a worse case snagging.

The high stiffness of the platen and impacting print hammers impart substantial vibration and vibrational amplitudes in the hammerspring that limits the rate of firing. This tends to limit and diminish the uniformity of print densities from dot impact to another respective dot impact. The rate and quality of the printing is constrained by the material of the platen being of a hard non-forgiving metal. As can be appreciated, the vibrational modes and bounce effect of the hammers against the stiff hard platen create inconsistencies in printing thereby providing inconsistencies in not only appearance but accuracy in such items such as bar codes.

Other prior art platens employ a rubber or elastomeric platen. The impact forces generated by the small tips of the hammers are so high in these cases that the compressive fatigue strength of the rubber and its elastomeric nature is exceeded. During printing for a number of hours a rubber or elastomeric platen experiences a permanent deformation under the tips. This tends to change the print quality and overall ability of maintaining the net result of trying to protect the ribbon and diminish vibrational modes. Further to this extent, such rubber platens experience wear by the continual rubbing of the paper. The paper also has a drag applied to it. Summarily, the net result is that the platen experiences an excessive wear and compression factor.

This invention solves the foregoing drawbacks of the prior art by an inventive use of two basic components that are placed on the platen. These are formed by an elastomer and tiny ceramic balls, metallic balls, or hard material particles toward the surface of the elastomer. This combination provides an exterior band or cross-sectional depth of non-wearing very hard tiny hard ceramic, metallic spheres, powder or particles. These spheres, particles, or powder next to the surface of the elastomer function to overcome many of the wear and impact deficiencies of the prior art as enunciated hereinbefore.

One of the enhancements is the media or paper rubbing on the hard ceramic, metallic balls, or particles does not excessively wear the elastomeric material. Furthermore, the combination of hardened balls, powder or particles on the surface and elastomeric material surrounding them, allows a reduction in compressive forces. The result is the elastomeric material does not tend to break down as in the prior art. These advantages and other features of this invention will be readily seen as described hereinafter in the specification and related claims.

SUMMARY OF THE INVENTION

In summation, this invention comprises a resilient elastomeric line printer platen having a metal core with an elastomeric layer toward the paper contacting side filled with ceramic, metallic, or hard material in the form of spheres, particles, powder, or flakes toward the surface.

More particularly, the invention comprises a line matrix printer platen having an elongated metal configuration as in the case of a normal platen. The elongated metal platen can be provided with a size in order to adhere an elastomeric material thereon in effect covering up that portion of the metal core.

The elastomeric coated material is such where it is provided with ceramic materials, or other hard particles including metals, alloys or carbides, which can closely approximate spherical members on the exposed layer proximate the paper that passes thereover or be in the form of a powder, disparate particles, or flakes. This serves to resist the impact wear caused by the hammersprings and the abrasive wear caused by the paper motion.

The invention allows faster operation of the printer and greater compressive fatigue strength with improved abrasive wear resistance as to the paper rubbing thereover. The elastomeric portion of the platen allows the absorption of impacts for increased printing speed while at the same time minimizing compression set of the elastomer by the use of the ceramic, hardened, or metallic material at the surface. By adding the band of non-wearing materials toward the surface, a resolution of the set of the paper is substantially eliminated and the elastomer does not become compressed and set in various impacted portions. Furthermore, the paper rubs on the hardened material to prevent wear while at the same time allowing a reduction in compressive forces so that the compressive fatigue strength of the elastomer is not exceeded.

The ceramic, metallic, or hard material particles are packed closely together at the surface. Impacts are absorbed through multiple ceramic or metallic material portions that in turn are absorbed within the elasticity of the elastomer. This results in an expansion of the area in which the impact force is distributed. The effect is to diminish the compressive fatigue stress of the elastomer materials so that compressive set is diminished.

As will be seen hereinafter, the improvements as enunciated hereinbefore will be apparent from the specification and the claims.

BRIEF DESCRIPTION OF THE DRAWINGS

FIG. 3 is a fragmented perspective view of the platen of this invention generally shown as the platen in FIG. 1.

FIG. 4 is a perspective fragmented view of an alternative platen that is cylindrical in shape.

FIG. 6C shows the view analogous to FIG. 6A with the particles being shown in random contact with each other.

DESCRIPTION OF THE PREFERRED EMBODIMENTS

Figures 1, 6B:
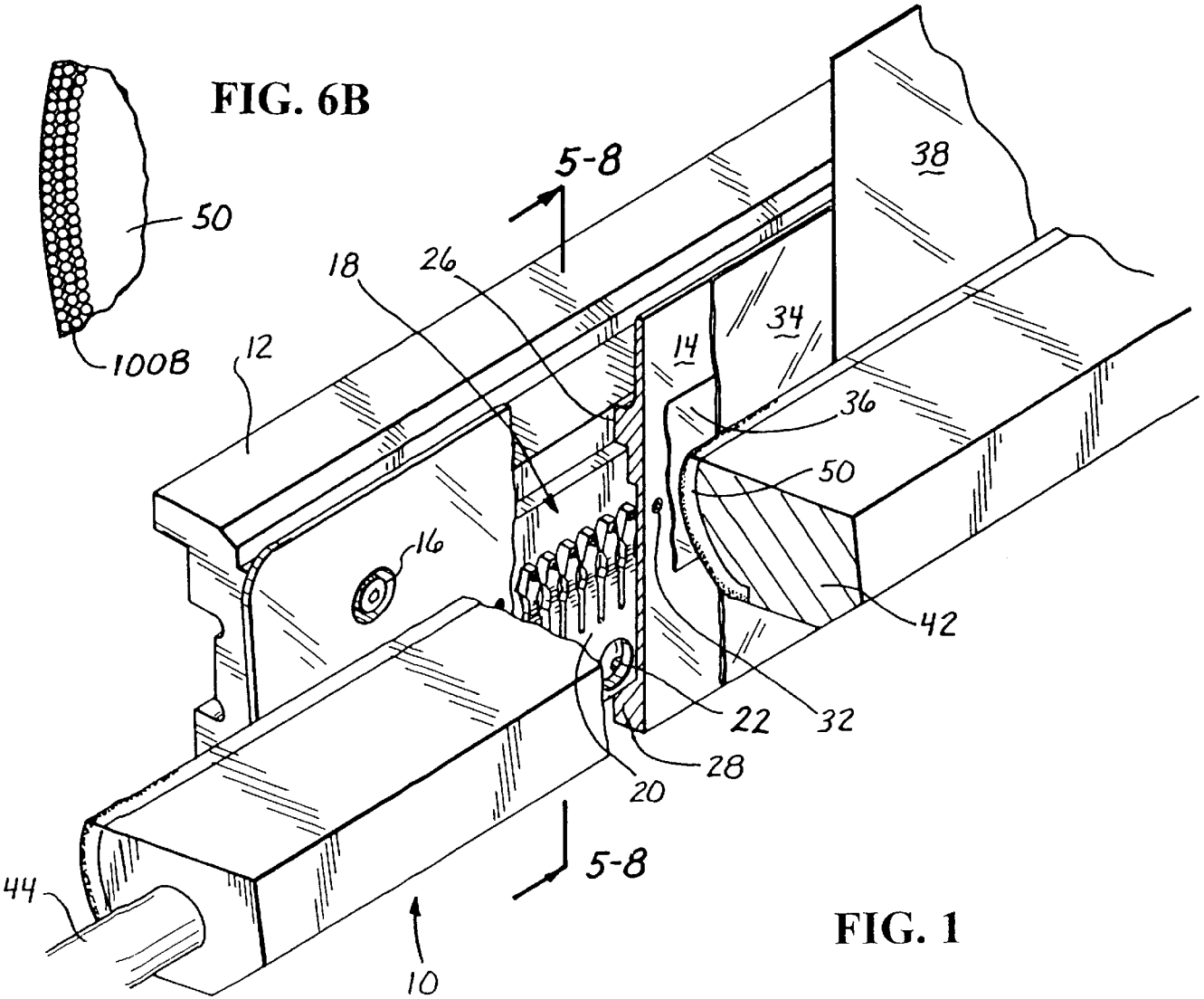
FIG. 1 is a perspective view of the platen of this invention in conjunction with the hammerbank, paper or media, cover, ribbon and ribbon mask with a portion sectionally fragmented therefrom.
FIG. 6B is a sectional view analogous to FIG. 6A showing the particles disposed five in depth into the elastomer.

FIG. 1 shows a general overview as partially sectioned, of the resilient platen with a hammerbank and associated apparatus. Looking more specifically at FIG. 1 it can be seen that a platen 10 is shown that has been sectioned. The platen 10 is in proximate longitudinal associated relationship with a hammerbank 12. The hammerbank 12 has a cover 14 thereover which has been secured to it with a number of threaded members such as screws, bolts, or other securement means 16.

Figure 1A:
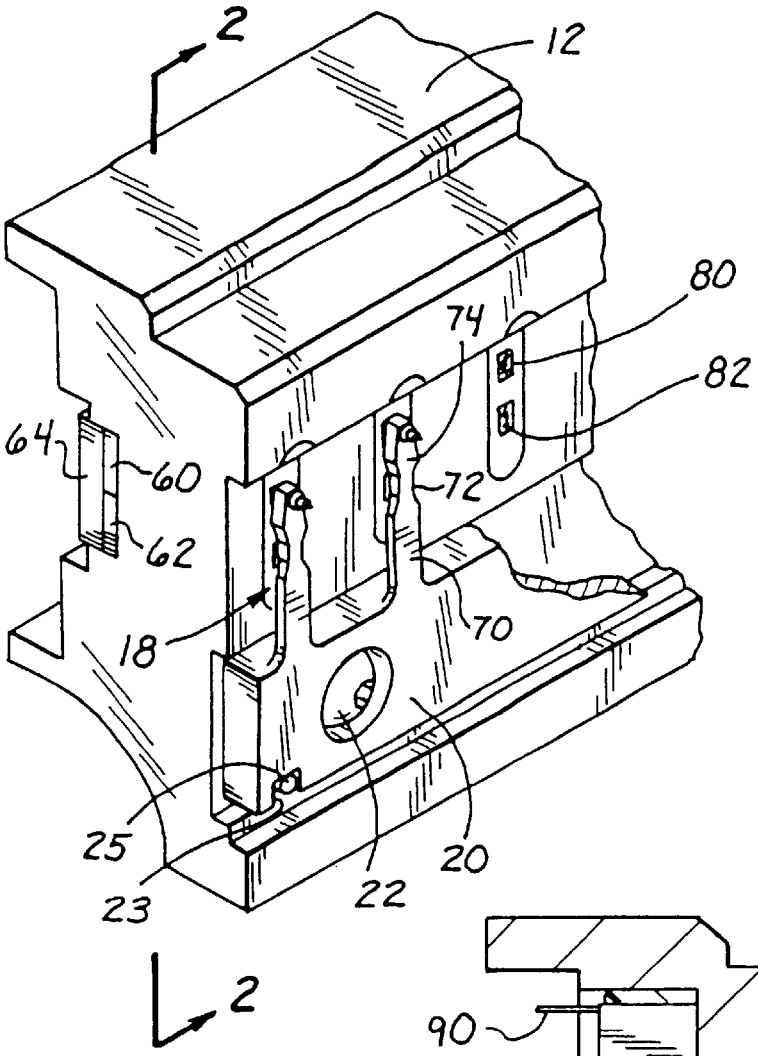
FIG. 1A is a perspective fragmented portion of the details of the hammers and hammerbank as shown in FIG. 1.

The hammerbank 12 carries a plurality of hammers 18 that are formed on a fret 20 that is secured to the hammerbank by a threaded securement such as a screw or bolt 22 and is indexed by an indexing pin and notch generally shown as notch 23 and pin 25 in FIG. 1*a*. Each of the plurality of hammers 18 can be seen in greater detail in the other figures having tips which will be exemplified hereinafter.

The cover 14 has upper and lower longitudinal ribs or pedestal portions 26 and 28 which provide stiffening reinforcement of the cover. These in turn improve the performance of the hammerbank as to any torsional or other moments that cause bending or improper orientation of the hammers 18 when firing.

The hammers 18 are also oriented such that they fire their printing tips through openings 32 in the cover which are indexed to openings in a mask 34 which masks a print ribbon 36 from the media which is to be printed upon. In particular, media 38 such as paper is passed through the throat or the space between the platen 10 and the mask 34 to facilitate printing thereon.

The hammers 18 are released with their tips passing through the openings 32 of the cover 14 and the mask so that the ribbon 36 can be impressed against the media or paper 38. The media or paper 38 rests against the platen 10 and is impacted thereby.

The platen specifically has a configuration wherein the core 42 is made of metal and is supported at either end by a shaft 44, only one of which is shown. The shaft 44 allows the platen 10 to be moved inwardly and outwardly with respect to the media or paper 38 and the cover 14 and hammerbank 12. Thus, the thickness or the width of the throat between the cover 14 and the platen 10 can be adjusted depending upon the amount of media 38 or thickness of forms that are passing therethrough. Furthermore, the shaft 44 can be rotated so that the platen 10 can be opened and closed in a more facile manner. The shaft 44 can be affixed to the platen 10 in any manner or formed therewith. In this particular case, it is a separately formed shaft 44 that is swaged or pressed fit into the platen 10.

Further details of the platen 10 show that a surface layer 50 is shown. The surface layer 50 is formed of elastomeric material that has been bonded to the platen 10 and has a number of small ceramic or metallic portions or other hard particles at its surface. These small ceramic or metallic portions can be a near spherical group of balls, flakes, powders, or other formations that are on the surface and help to harden the surface in the manner that will be expanded upon hereinafter.

Figure 2:
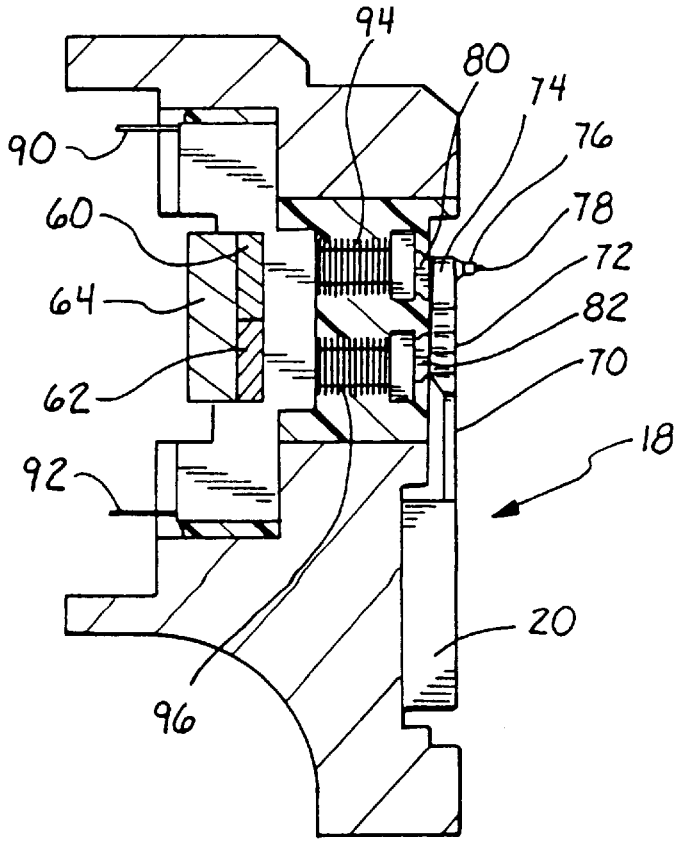
FIG. 2 is a sectional view of the hammerbank along lines 2—2 of FIG. 1*a*.

Greater detail of the hammerbank 12 is shown in FIGS. 1*a* and 2. These particular figures show the hammerbank 12 having magnets 60 and 62 that have been split from a single magnet to provide retention of the hammers in the manner to be described. The magnets 60 and 62 are connected by a coupler 64 that provides a magnetic coupling between the magnets 60 and 62.

The plurality of hammers 18 can be seen formed with the fret 20, and affixed to the hammerbank 12 by way of a threaded bolt or screw 22. The hammers 18 and fret 20 are machined, cut, or formed from common stock so that the hammers extend from the fret. Each hammer 18 comprises a base portion 70 and a necked down upper portion 72 terminating in an enlarged portion 74. The enlarged portion 74 has a tip 76 with a small portion or striking portion 78 of the tip 76 welded thereto or brazed. These respective hammers 18 are magnetically held against upper and lower pole pieces respectively 80 and 82.

The pole pieces 80 and 82 are interconnected by the magnets 60 and 62 through a magnetic circuit and retain the hammers 18 against or proximate the surface of the pole pieces 80 and 82 until released. Release is accomplished by providing a current or voltage on respective lines 90 and 92 that are connected to continuous coils 94 and 96. This overcomes the magnetism of the magnets 60 and 62 through the pole pieces 80 and 82. This allows a release of the hammers 18 to fire with the tips 76 and their striking portion 78 against the attendant print ribbon 36 and attendant media or paper 38.

Looking more specifically at FIGS. 3 and 4 it can be seen that the platen 10 has been shown in FIG. 3. The platen 10 has the elastomeric resilient material 50 on the surface and as can be seen a schematic showing of the ceramic, metallic, or hard particles is shown at the surface area which will be detailed hereinafter. These hard particles 100 are formed into the surface in a manner that will be described in the more detailed showing of FIGS. 5 through 8.

Oftentimes, platens are cylindrical as can be seen in FIG. 4. This has been shown as an alternative platen 10*a* with a shaft 44*a* and elastomeric material 50*a*. Here again, ceramic, metallic, or a hardened surface material has been emplaced in the elastomeric material 50*a* namely ceramic material 100*a*.

Figure 5:
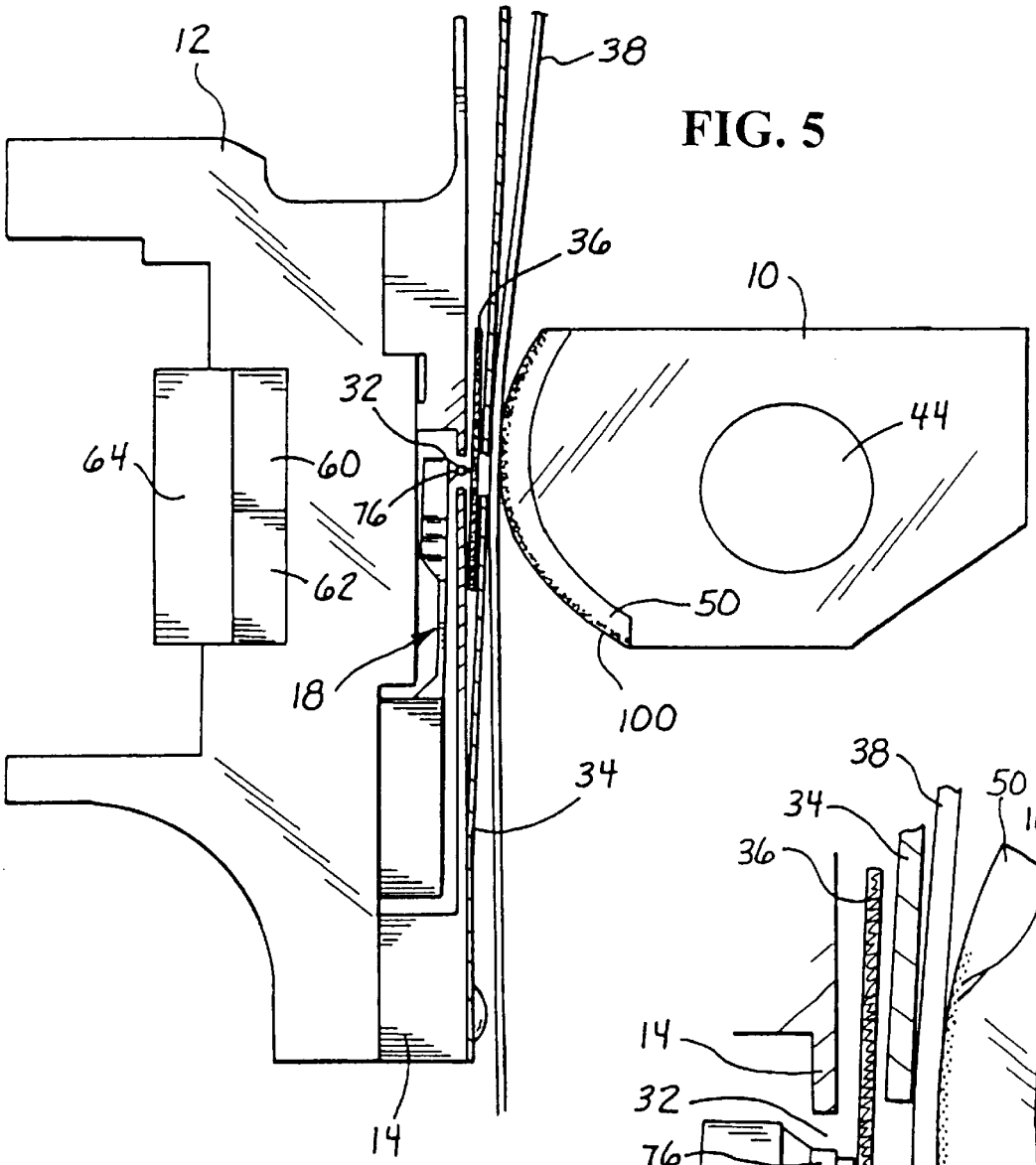
FIG. 5 is a view of the platen and hammerbank oil this invention as seen and sectioned along lines 5–8 of FIG. 1.

Looking more specifically at FIG. 5, it can be seen that the platen 10 has been shown and the hammerbank 12. Here again, the magnets 60 and 62 are shown with a magnetic coupler 64.

The platen 10 includes shaft 44 and the elastomeric material 50 with the surface ceramic, metallic, or hardened particles 100.

Figure 6:
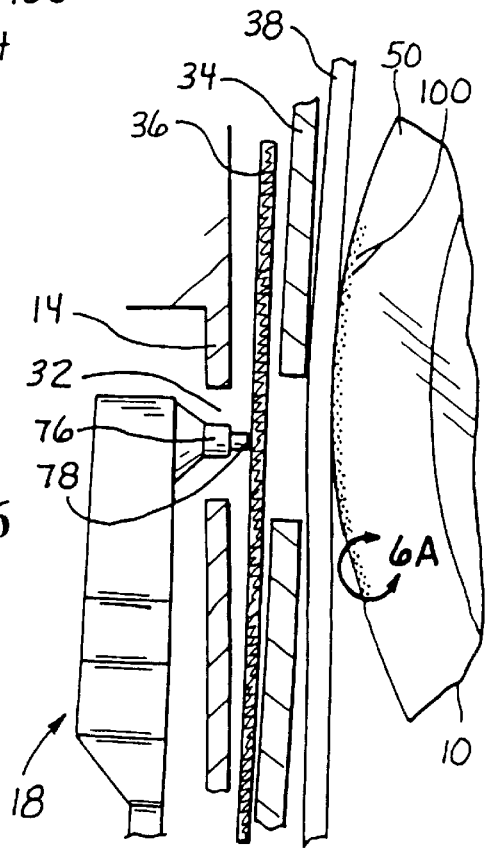
FIG. 6 is a detailed view of the showing of the hammers, paper, and platen as shown in FIG. 5.
Figure 6A:
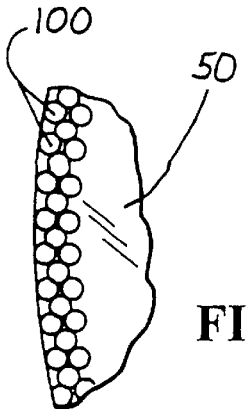
FIG. 6A is a detail of the platen as encircled by circle 6*a* of FIG. 6.

In the particular showing of FIG. 5, with the detail of FIG. 6, the hammer 18 has not been fired and is in a retracted position. It is retracted by the magnetic circuit provided by magnets 60 and 62 through the pole pieces 80 and 82. At this particular point, the hammer 18 is ready to be fired against the ribbon 36 with the mask 34 protecting it from the media or paper 38 that is to be printed upon. Here again, the cover 14 has been shown as secured to the hammerbank 12.

At this juncture, the tip of the hammer namely tip 76 is ready to be fired and impact the ribbon 36 with its small reduced end or striking portion 78. The impacting of the ribbon 36 is such where the hammer tips 76 will impact the ribbon and then the media through the openings 32 and the indexed opening adjacent thereto in the mask 34. In the prior art this will cause the reduced hammer tip portions 78 to impact the surface of the platen 10 in a hard manner such that it normally creates vibrational modes and dynamic forces within the hammers 18. This sets up vibrational modes so that inaccuracy of the print at the hammer tip ends 78 is enunciated. However, with the elastomer 50 and ceramic, metallic, or hardened particles 100 a vast improvement over the prior art is accomplished.

Figure 7:
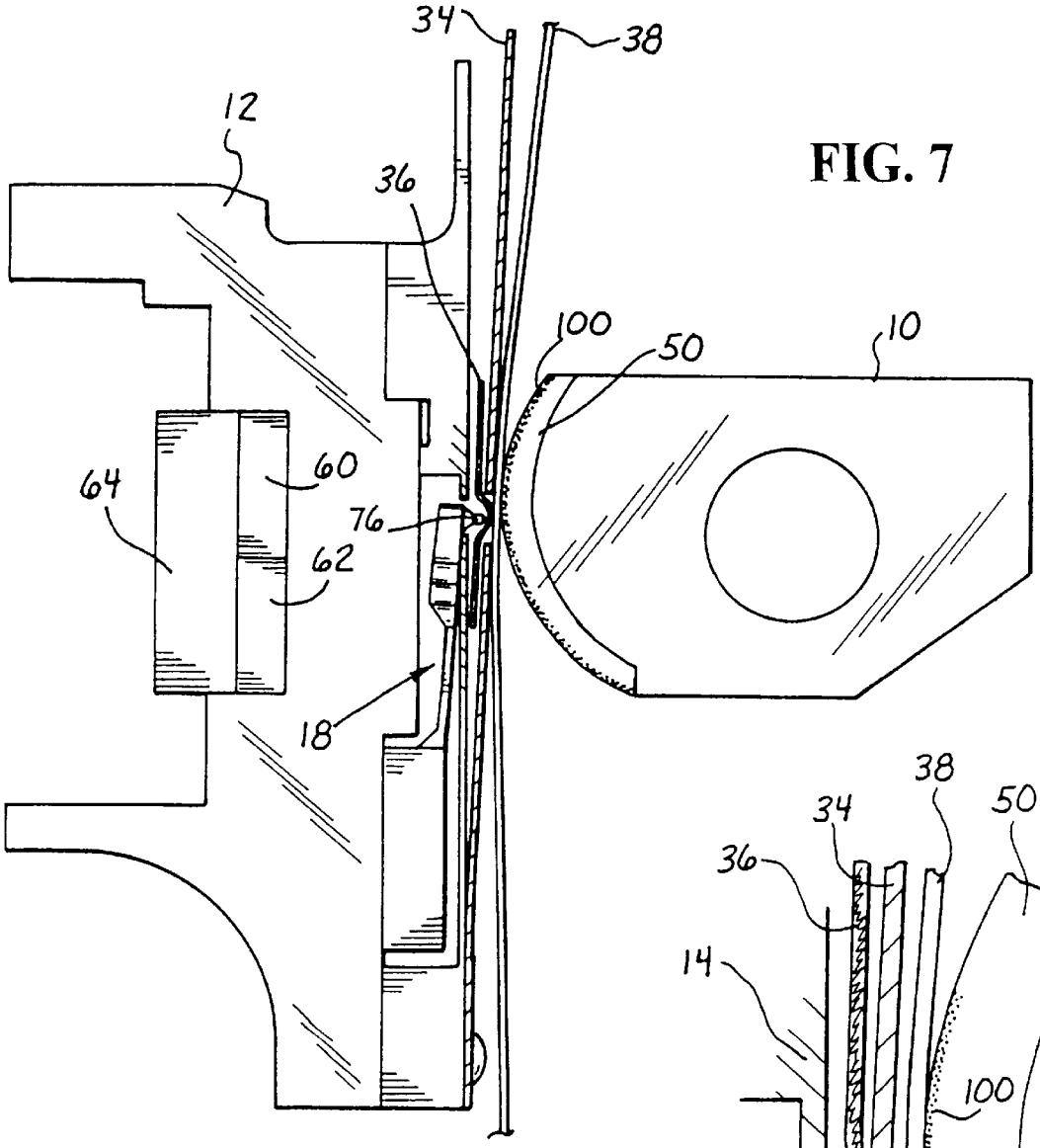
FIG. 7 is a sectional view of the hammer impacting the platen similar to that shown in FIG. 5.
Figure 8:
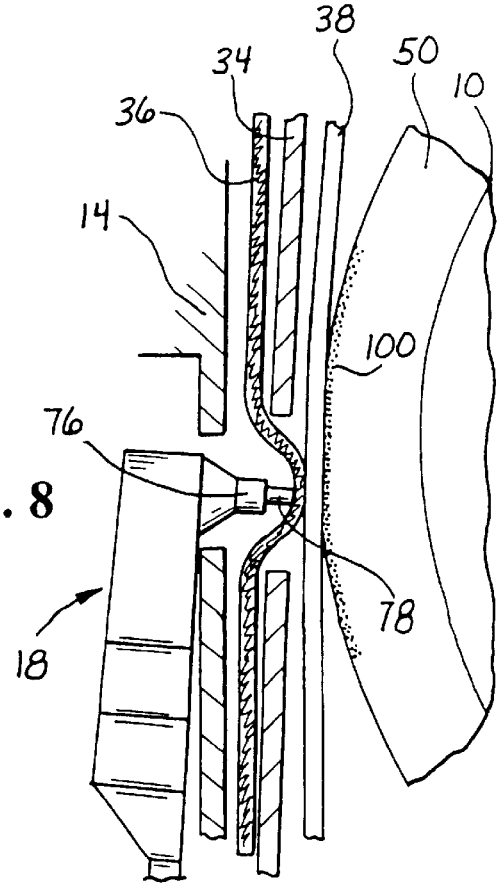
FIG. 8 is a detailed view similar to FIG. 6, but showing the impact of the hammer against a ribbon and the underlying platen.

In FIGS. 7 and 8, the hammer 18 has been released. It can be seen striking the ribbon 36 with the mask 34 masking the ribbon and the underlying media or paper 38 on which a dot and series of dot matrix alpha numeric symbols or bar codes are to be printed on the media or paper 38. The hammer 18 as seen in FIGS. 7 and 8 has been released and strikes the ribbon 36 in such a manner as to cause it to be under some stress. It is bowed a little bit by the impact through the opening of the mask 34 as it impacts the paper 38. This invention serves to cushion the impact of the tip ends 78 by means of the elastomeric material 50 and the ceramic, metallic, or hardened materials 100 imbedded in the elastomeric material 50.

The surface layer of elastomeric material 50 can be filled with a ceramic, metallic, or hard material forming a powder in the form of ceramic, metallic, hard flakes, or other particles 100. These ceramic, metallic, or hard particles 100 can be near-spherical ceramic powders. The ceramic, metallic hard powder helps to diminish the impact fatigue set of the elastomer and also the abrasive wear of the elastomer caused by the paper moving over the elastomeric material 50.

The foregoing helps to diminish the impact impulsive force of the tip ends 78 against the ribbon when it would be normally impacting against a solid metal surface. Such impacts as previously stated can permanently flatten the threads of the ribbon 36 and cause ribbon snagging. Furthermore, the high stiffness imparts excessive vibration amplitudes to the hammersprings 18 that limit their rate of firing. This result diminishes uniform print densities from the successive dot impacts. In effect, the rate of printing and the quality of printing is constrained by the material of the platen. The printing characteristics are improved as the platen with purely hardened metal at the surface is replaced by the elastomeric platen with ceramic, metallic, or hardened particles at the surface.

It has been found that the inclusion of the ceramic, metallic, or other hard material 100 tends to strengthen the elastomeric material as to impact. The deformation under the tip ends 78 that would cause a change in print quality is diminished and the wear by a continual rubbing of the paper against an elastomeric material such as elastomer 50 is diminished.

The composite of the elastomer containing the tiny ceramic, metallic, or hardened materials at the surface substantially eliminates the problem of wear.

The ceramic, metallic, or hardened material 100 is packed relatively closely together so that one piece of material when impacted pushes on another. The mutual impacts might be direct or coupled with elastomer between particles. This allows a diminishing of the impacts against just one particle or spheroid by cushioning it through the chain reaction against each other. The spheres or pieces of ceramic, metallic, or hardened material are in turn cushioned by the elastomer. The result is an expansion of the area that the force of the hammer tips 78 is distributed, so that the compressive fatigue stress is not exceeded. Therefore, compression set is diminished as to the elastomer and wear is greatly reduced.

The platen 10 core can be made from typical commercial steel such as low or medium carbon or low alloy steel or other metallic alloys, such as aluminum alloys. The core is then plated with nickel, chromium or anodized to prevent atmospheric corrosion on the platen surface.

Elastomeric material is emplaced thereon in the form of the elastomeric material 50 that can be either synthetic, natural materials or a combination of both. Among such materials are polyurethane rubbers that provide a sufficient performance.

The total thickness of the elastomeric material layer 50 when placed on the platen 10 is of such thickness that it should be greater than approximately 0.010" and has a preferred range 0.020" to 0.125". The hardness of this elastomer should be in the range of Shore A 80 to Shore D 80. It is felt that the preferred range of Shore D 50 to Shore D 60 in many cases provides optimum performance.

The ceramic, metallic, or hard metal alloys is the form of the preferred material to resist surface wear. They provide a thin surface overlay which is heavily filled with the ceramic, metallic, or hardened material including metal alloys. This ceramic, metallic, or other hard material can be in the form of beads, spheres, spheroids, near-spheres powders, flakes, or other hard material that can receive the impact and spread the load through the elastomeric material 50. Such beads or sphere like materials preferably have a sphericity no less than 0.50 but preferably greater than 0.90 and the particle size is in the range of 1 micron to 2 mm. However, in some cases solid ceramic, metallic, or hardened materials such as any solids including flakes and irregular shaped particles can also be utilized.

The ceramic material can be an oxide nitride or silicate of aluminum zirconium or like materials. The metallic material can be ferrous, or non-ferrous metals or hard alloys. The surface layer of the composite material 100 in the elastomer 50 can range from 5 percent of the thickness of the elastomeric material to approximately 35 percent of the thickness. It is felt that the preferred layer can be approximately (0.005") 0.005 inches as a minimum.

Summarily, the surface of the elastomeric layer should have a thin surface overlay, which is heavily filled with metal, carbide hard powders, flakes or ceramic beads. This can be applied in the form of a powder. The materials of the overlay 100 used for the application can be steel, such as stainless steels; carbon steels, alloy steels and tool steels;

superalloys, such as nickel, cobalt, titanium or chromium alloys; carbides, such as tungsten carbides, chromium carbides, boron carbides as well as ceramic vitreous materials, powders, and beads. The beads can be in either irregular or spherical form, and the particle sizes can be in the range of 1 micron to 2 mm. The optimal range of the particle sizes for all the foregoing hard materials is 20 microns to 400 microns. The material should have a minimum hardness of HRC 20, or in the range that is adequate to withstand the continuous wear caused by the tip impacts and paper motion. The thickness of this surface layer 100 should be of, (0.005") 0.005 inches minimum.

Figure 6D:
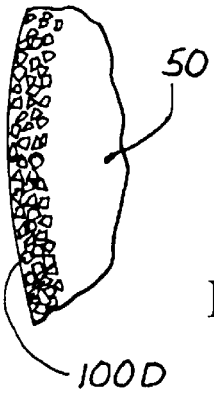
FIG. 6D shows particles analogous to FIG. 6A in a form from irregularly shaped ceramic material.

Materials of the overlay 100 can be material or particles in random contact with each other and extend into the surface and depths measured by numbers of pieces of material to the extent of upwards of three to five pieces in depth. Also, the material can be in random contact with each other. FIG. 6B shows particles 100B five in depth; FIG. 6C shows particles 100C in random contact and orientation; and FIG. 6D shows particles 100D that are irregularly shaped ceramic materials and of multi configurations.

As can be appreciated other configurations of the elastomer as to the type and the ceramic material can vary by one skilled in the art.

From the foregoing, it can be seen that the hammer 18 impacts by the tips 78 are substantially absorbed in the ceramic, metallic, or hardened material 100 and spread through the elastomer 50 as it is in its affixed condition against the surface of the platen 10.

The foregoing is a substantial step over the printer art as will be claimed.

What is claimed is:

1. A platen and an impact printer having a plurality of hammers with tips which impact a ribbon for printing wherein:

said hammers are held by a permanent magnet until released by an electrical coil;

said platen comprising:

a metal member;

an elastomer bonded to said metal member and having an impact surface for receiving the impact of said tips; and, a multiplicity of pieces of material harder than said elastomer embedded at the impact surface of said elastomer.

2. The platen as claimed in claim 1 further comprising:

said pieces of material extend up to three pieces in depth from the impact surface.

3. The platen as claimed in claim 1 further comprising:

said pieces of material extend up to five pieces in depth from the impact surface.

4. The platen as claimed in claim 1 further comprising:

said pieces of material extend from the surface of said elastomer in random contact with each other.

5. The platen as claimed in claim 1 wherein:

said pieces of material are formed with a sphericity of at least 0.50.

6. The platen as claimed in claim 1 wherein:

said pieces of material are sized in the range of 20 microns to 400 microns.

7. The platen as claimed in claim 1 wherein:

said pieces of material are of irregularly shaped ceramic material.

8. The platen as claimed in claim 1 wherein:

said pieces of material comprise metal, carbide, or ceramic materials.

9. The platen as claimed in claim 1 wherein:

the thickness of said elastomer is in the range of 0.020 inches to 0.125 inches.

10. The platen as claimed in claim 9 wherein:

the hardness of said elastomer is in the range of Shore A 80 to Shore D 80.

11. The platen as claimed in claim 1 wherein:

the depth of said pieces of material from the surface of said elastomer is up to 35 percent of the thickness of said elastomer.

12. A line printer comprising:

a hammerbank having a plurality of print hammers with printing tips held by a permanent magnet until released by an electrical coil;

a ribbon supported for impact by the tips of said hammers;

means for providing media to be printed upon by impacting said ribbon against said media by said tips;

a metal platen for supporting the media upon impact;

an elastomeric surface on said metal platen; and, a layer of material harder than said elastomeric surface extending inwardly from said elastomeric surface.

13. The line printer as claimed in claim 12 wherein:

said harder material comprises particles extending at least two in depth from the surface of said elastomeric surface.

14. The line printer as claimed in claim 12 wherein:

said harder material comprises particles extending randomly at least three in depth from the surface of said elastomeric surface.

15. The line printer as claimed in claim 13 wherein:

said particles are ceramic and have a sphericity exceeding 0.50.

16. The line printer as claimed in claim 13 wherein:

said particles extend from the surface of said elastomer up to 35 percent of the thickness of said elastomeric surface.

17. The line printer as claimed in claim 13 wherein:

said particles are in the range of 20 microns to 400 microns.

18. A dot matrix line printer comprising:

a hammerbank having a plurality of hammers, with printing tips, retained by permanent magnets until released by coils overcoming the magnetic retention thereon;

a print ribbon for printing on print media by the impact of said tips;

a metal platen for supporting said media when impacted by said tips having an elastomer; and, a layer of material formed of solid particles harder than said elastomer at the surface of said elastomer which is impacted.

19. The printer as claimed in claim 18 wherein:

said layer of harder material is comprised of particles between 20 microns to 400 microns in size.

20. The printer as claimed in claim 18 wherein:

said layer of harder material is up to 35 percent of the thickness of said elastomer.

21. The printer as claimed in claim 18 wherein:

said layer of harder material comprises ceramic particles having a sphericity of at least 0.50.

22. The printer as claimed in claim 21 wherein:

said ceramic particles extend at least three deep into the elastomer to provide interacting impact between said particles.

23. The printer as claimed in claim 18 wherein: said harder material is comprised of a metal, carbide, or vitreous materials.

24. A method of making a line printer platen for absorbing impacts by tips of print hammers held by a permanent magnet until released by an electrical coil in a hammerbank comprising:

providing a metal platen;

placing a layer of elastomer on said metal platen for receiving the impacts of the tips; and, embedding solid particles of material in said elastomer from the surface which are harder than said elastomer.

25. The method as claimed in claim 24 wherein:

said particles are vitreous particles having a sphericity greater than 0.50.

26. The method as claimed in claim 24 wherein:

said particles are in the range of 20 microns to 400 microns in size.

27. The method as claimed in claim 24 further comprising:

embedding said particles from the surface of said elastomer to a depth no greater than 35 percent of the thickness of said elastomer.

28. The method as claimed in claim 24 wherein:

said particles are metal, carbide, or ceramic.

* * * * *